US005876104A

United States Patent [19]

Kunkel et al.

[11] Patent Number: 5,876,104

[45] Date of Patent: Mar. 2, 1999

[54] BREAKER ASSEMBLY FOR REFRIGERATED CABINET

[75] Inventors: Joe Kunkel, Clearwater; Glenn Johnson, Sauk Rapids; Kevin Hakala, St. Louis, all of Minn.

[73] Assignee: White Consolidated Industries, Inc., Cleveland, Ohio

[21] Appl. No.: 988,626

[22] Filed: Dec. 10, 1997

[51] Int. Cl.[6] ..... A47B 91/00

[52] U.S. Cl. ..... 312/406.1; 220/433; 220/444

[58] Field of Search ..... 312/400, 406, 312/406.1, 406.2, 265.5; 220/431, 433, 436, 444, 467

[56] References Cited

U.S. PATENT DOCUMENTS 2,662,660 12/1953 Frykdahl .
2,679,944 6/1954 Morton .
2,873,041 2/1959 Allen .
3,380,615 4/1968 Kessler .
3,915,328 10/1975 Hawes ..... 312/406.2
4,134,627 1/1979 Kuskowski .
4,469,383 9/1984 Losert .
5,368,381 11/1994 Mandel .
5,584,551 12/1996 Jenkins .

*Primary Examiner*—Peter M. Cuomo
*Assistant Examiner*—Gerald A. Anderson
*Attorney, Agent, or Firm*—Pearne, Gordon, McCoy & Granger LLP

[57] ABSTRACT

An inner liner is installed in an outer shell. A breaker panel assembly has four panels and four corners that form a rectangle. The assembly closes an insulation space around the front door opening between the liner and shell. Retainers on the panels engage the liner and shell. Retainers on the corners engage the panels an permit slight movements of the panels. Foam insulation is injected in the insulation space. The breaker assembly complements the inner door contour to minimize the air gap and exposed surface of the door gasket.

14 Claims, 4 Drawing Sheets

34
72
14
32
66
12
44
70
49
68
76
42
74

BREAKER ASSEMBLY FOR REFRIGERATED CABINET

BACKGROUND OF THE INVENTION

This invention relates generally to the field of refrigerators and freezers and specifically to a cabinet having an improved breaker assembly.

Household refrigerator and freezer cabinets commonly include a metal liner installed in a metal shell. The liner and shell define a front opening that is closed by a door. An insulation space between the liner and shell is filled with insulation, such as foam. A breaker panel frames the front opening and closes the front of the insulation space. The insulation space can be filled before or after the breaker panel is installed. Desirable features of the breaker include good insulating properties, strength, durability, ease of assembly, and an attractive appearance when installed. The breaker panel should be easy to install and adapt to dimensional variations of the cabinet resulting from such causes as thermal expansion and contraction or misalignment.

BRIEF SUMMARY OF THE INVENTION

The present invention provides a cabinet having an outer shell and an inner liner disposed in the shell. A breaker assembly includes four panels and four corners joining the panels to form a rectangle. Each panel has a generally L-shaped cross section including a stem and a branch. A first retainer at an end of the stem retains an edge of the inner liner, and a second retainer at an end of the branch retains an edge of the outer shell. Each corner has a generally flat front face corresponding with the branches of adjacent panels, an arcuate inner face corresponding with the stems of adjacent panels, and panel retainers along edges of the corner corresponding with the adjacent panels. Each panel retainer has a flange projecting laterally from rear faces opposite the front and inner faces and bent toward the panels to retain ends of the panels between the flange and the rear faces. Foam insulation is disposed between the liner and shell.

The length of the panels and depth of the corresponding panel retainers permit movement of the panel ends parallel with the length of the panels and within the retainers. The first retainer receives the edge of the inner liner between the end of the stem and an end of the first retainer and the second retainer receives the edge of the outer shell between the end of the branch and an end of the second retainer. The first retainer includes a leg projecting laterally from the stem and bent back toward the end of the stem and the second retainer includes a leg projecting laterally from the branch and bent back toward the end of the branch. The leg of the first retainer projects laterally from the stem, curves to form an acute interior angle with respect to the stem, and is bent back at an acute angle. The leg of the second retainer has a hook disposed for retaining the edge of the inner liner. The leg of the second retainer projects at a substantially right angle to the branch. The leg of the second retainer and the end of the branch cooperate to form pincers having a hook and defining a gap for receiving the edge of the outer shell. The outer shell has an inwardly bent flange, an edge of the flange defines the edge of the outer shell, and the second retainer retains the edge of the flange.

A movable door closes an opening defined by the shell and liner. The door has an interior contoured surface complementing the breaker assembly to provide a close fit therebetween. The door has a magnetic gasket for sealing with the shell flange.

DESCRIPTION OF THE INVENTION

Figure 1:
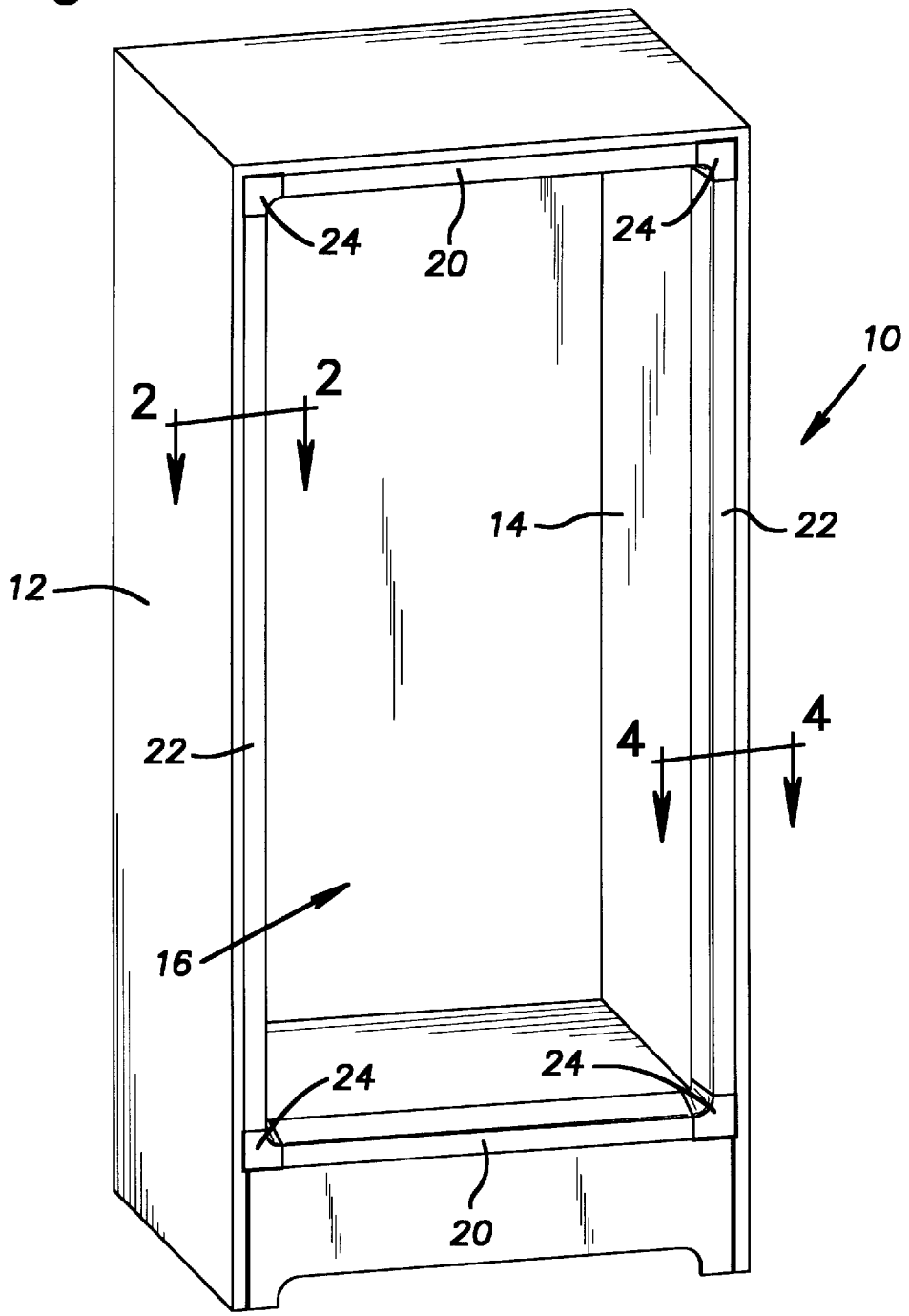
FIG. 1 shows a cabinet according to the invention.

Referring to FIG. 1, a cabinet 10 is provided for storing articles. Preferably, the cabinet 10 is a refrigerator and/or freezer cabinet for cooling the articles and storing cooled articles. The cabinet 10 includes an outer shell 12 and an inner liner 14. The liner 14 is disposed inside the shell 12 to define a generally parallelepipedic hollow interior having a generally rectangular front opening 16. The shell 12 and liner 14 are preferably made from formed sheet metal, the liner being painted prior to assembly, the shell being painted after assembly. Other materials, such as molded plastic may also be suitable for the shell and liner.

A breaker assembly includes two horizontal panels 20, two vertical panels 22, and four breaker corners 24 arranged to form a generally rectangular frame around the front opening 16. The breaker assembly components are made of extruded plastic. The horizontal and vertical breaker panels 20, 22 have substantially the same cross-section and differ only in length.

Figure 2:
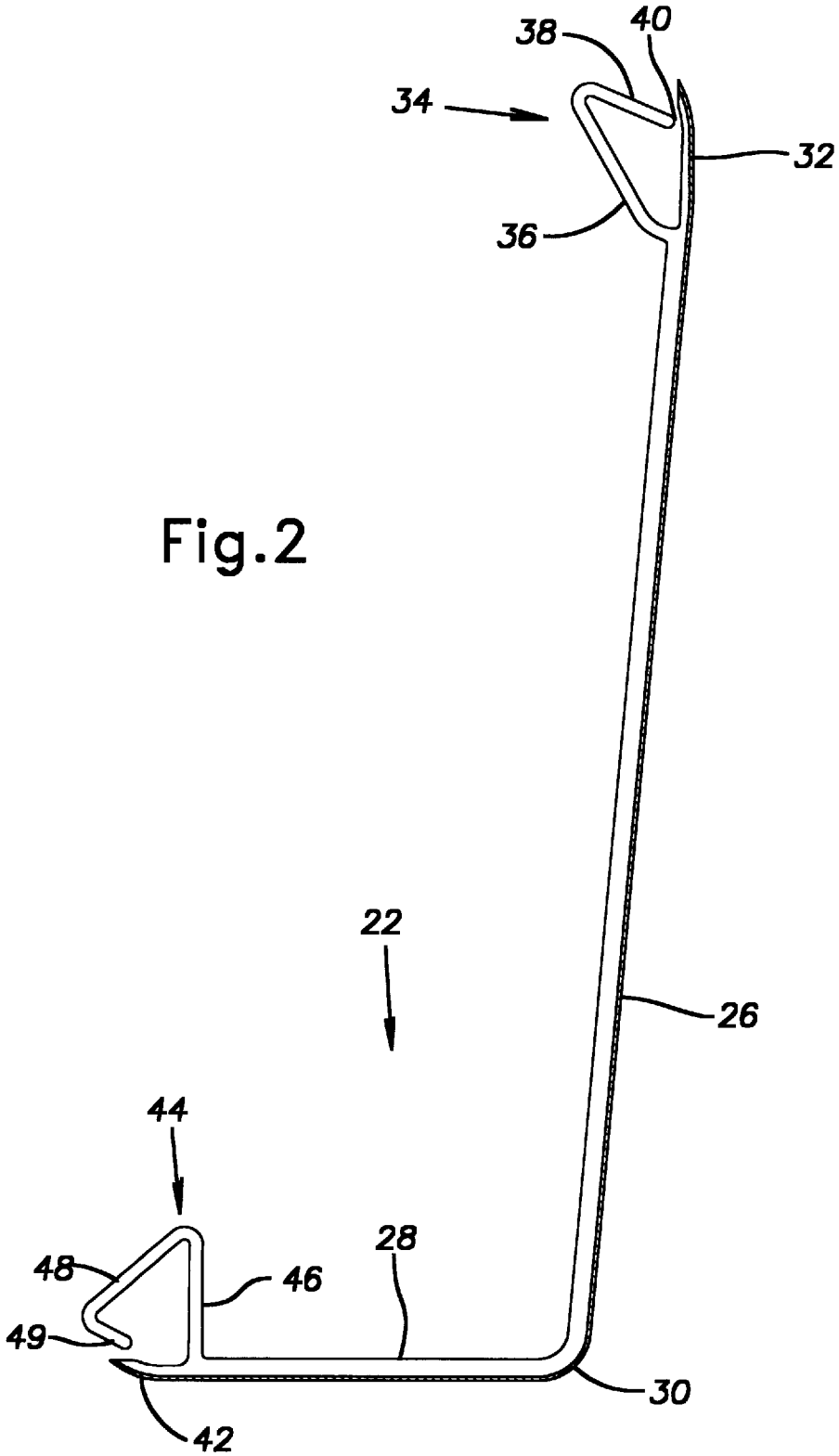
FIG. 2 shows a section of a breaker panel taken from line 2—2 of FIG. 1.

Referring to FIG. 2, the cross-section of the left vertical panel 22 is shown as an example of all four breaker panels. The panel includes a stem 26 and a branch 28 joined at a rounded corner 30 so that the panel has a generally L-shaped cross-section. Preferably, the stem 26 and branch 28 are joined at a 95° angle. An end 32 of the stem 26 opposite the corner 30 is provided with a liner retainer 34. The retainer 34 includes a leg 36 projecting laterally from the stem 26, preferably at a substantially right angle, curving somewhat toward the end of the stem to define a preferably 25° angle with respect to the stem and then curving back towards the stem, preferably at a 42° angle, to define a pincer 38. An end 40 of the retainer 34 is located close to the stem 26, preferably leaving a gap of about 0.010 inch, which is less than the liner thickness. The end 32 of the stem 26 is bent slightly toward the retainer 34. An end 42 of the branch 28 opposite the corner 30 is provided with a shell retainer 44. The retainer 44 includes a leg 46 projecting laterally from the branch 28, preferably at a 90° angle, curving back towards the branch, preferably at a 49° angle, and curving back further, preferably at a 78° angle, to define a pincer 48 having a hook 49. An end 50 of the retainer 44 is located close to the branch, preferably leaving a gap of about 0.060 inch, which is less than the shell thickness. The end 42 of the branch 28 is bent slightly toward the retainer 44. The breaker panels are preferably tri-extruded using Dow 495R Styrene as a base material, Dow 495R Styrene as cap stock providing a matte finish, and Dow Styrene XU 72551.08 as a foam barrier.

Figure 3:
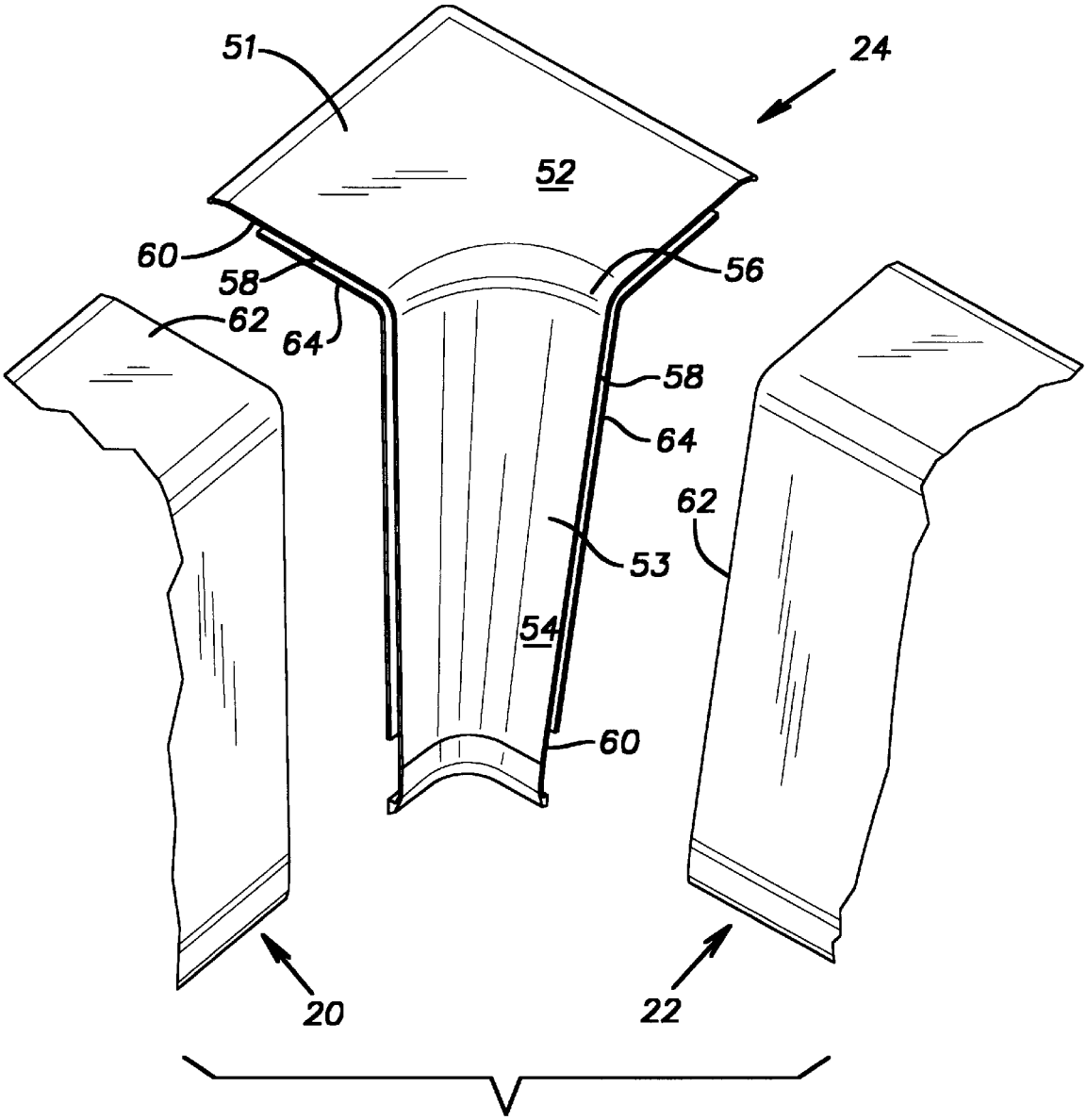
FIG. 3 shows a perspective view of a corner and ends of two panels.

Referring to FIG. 3, each breaker corner 24 includes a substantially flat portion 51 forming a front face 52 and an arcuate portion 53 forming an inner face 54. The flat portion 51 and arcuate portion 53 are joined at a rounded corner 56 so that a cross-section of the corner taken from a plane extending radially through the arcuate portion has an L-shape similar to the cross-section of the panels 20, 22. Panel retainers 58 are disposed along edges 60 of the breaker corner 24 corresponding with adjacent panels 20, 22. Each retainer 58 includes a flange projecting laterally from rear faces of the flat portion 51 and the arcuate portion 53. The flange is bent toward the adjacent edge 60 so as to be parallel with the corresponding flat portion or arcuate portion. An end 62 of the corresponding panel is received and retained between an edge 64 of the flange and the edge 60 of the corner. The retainer 58 provides for sufficient depth, that is distance from the edge 64 to where the flange projects from the rear face, to allow for movement of the panel ends resulting from slight dimensional changes of the cabinet and thermal expansion of the panels. The breaker corner is preferably injection molded Dow 495R Styrene.

Referring to FIGS. 1 and 3, the cabinet 10 is assembled by separately forming the outer shell 12 and the inner liner 14. The liner 14 is installed inside the shell 12 to define an insulation space therebetween. The breaker corners 24 are installed on the breaker panels 20, 22 to form the breaker assembly. The ends 62 of the breaker panels 20, 22 are retained by the panel retainers 58. The breaker assembly forms a rectangle, which is installed on the outer shell 12 and inner liner 14 to close the insulation space and frame the front opening 16.

Figure 4:
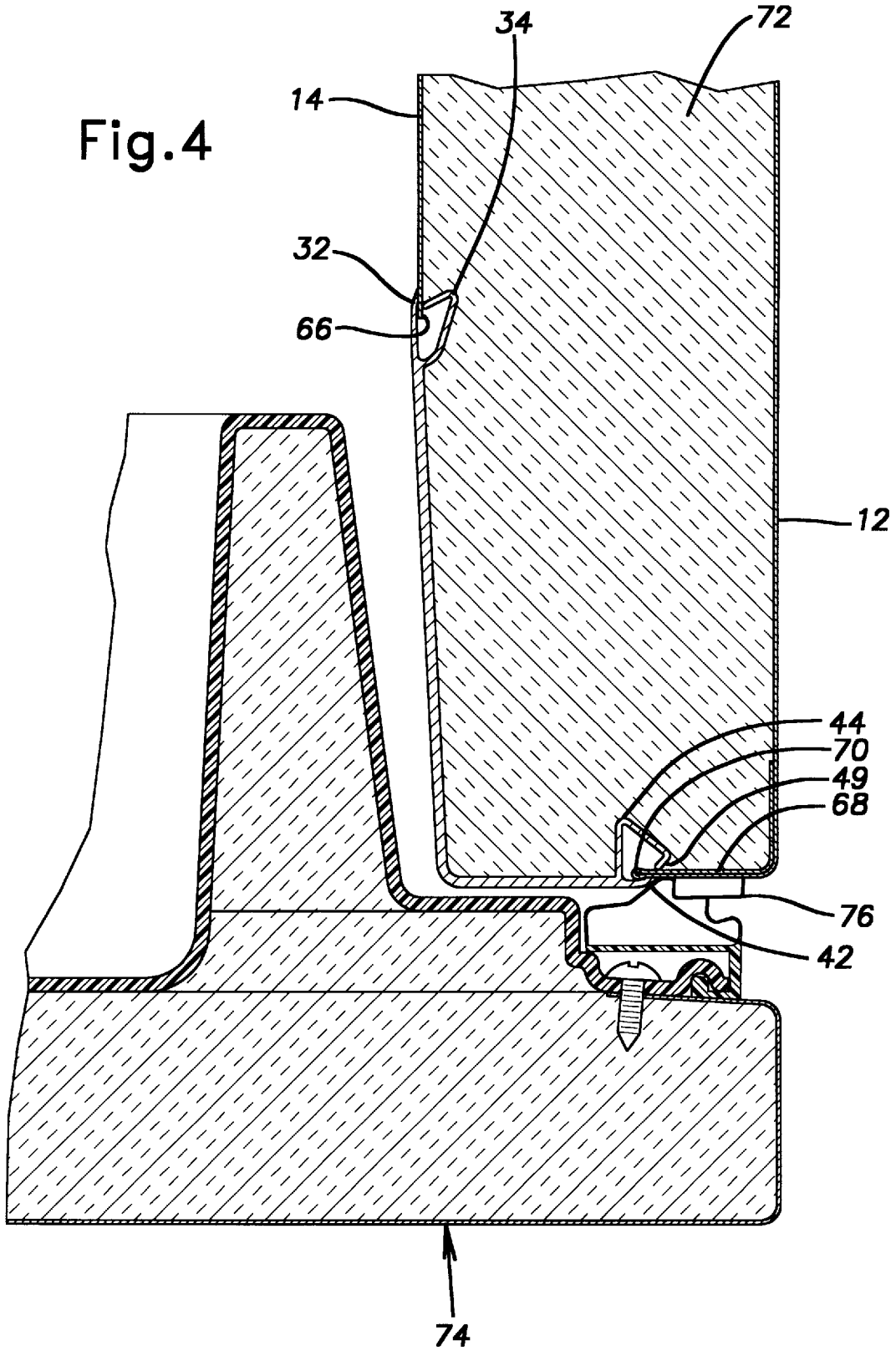
FIG. 4 shows a section view of the cabinet taken from line 4—4 of FIG. 1 and a section of a door closing the cabinet.

Referring to FIG. 4, an edge 66 of the inner liner 14 is received and retained between the end 32 of the stem and the corresponding retainer 34. The edge of the liner can be provided with a ridge to enhance retention. The outer shell 12 is provided with an inwardly bent flange 68 having an edge 70 received and retained between the end 42 of the branch and the corresponding retainer 44. The shell flange 68 is folded back on itself to form a double thickness for strength, which also forms a ridge for enhanced retention. The breaker material preferably provides resiliency so that the retainers 34, 44 bend slightly and tend to grab the liner and shell edges 66, 70. Foam insulation 72 is injected into the insulation space. The foam surrounds the retainers 34, 44 and holds the breaker assembly in place. An insulated door 74 is provided to close the cabinet. The door has a magnetic gasket 76 that engages and seals with the shell flange 68. The contour of the breaker panels 20, 22 and corners 24 substantially complement the contours of the door interior to minimize the air gap and exposed surface of the door gasket thereby minimizing air flow and heat gain. The breaker panels 20, 22 and corners 24 are nearly coplanar with the adjacent liner 14 and shell 12 surfaces to provide a smooth, finished appearance at the front of the cabinet opening.

The present disclosure describes several embodiments of the invention, however, the invention is not limited to these embodiments. Other variations are contemplated to be within the spirit and scope of the invention and appended claims.

We claim:

1. A cabinet comprising:

an outer shell;

an inner liner disposed in the shell;

a breaker assembly comprising four panels and four corners joining the panels to form a rectangle, each panel having a generally L-shaped cross section including a stem and a branch, a first retainer at an end of the stem retaining an edge of the inner liner, and a second retainer at an end of the branch retaining an edge of the outer shell, each corner having a generally flat front face corresponding with the branches of adjacent panels, an arcuate inner face corresponding with the stems of adjacent panels, and panel retainers along edges of the corner corresponding with the adjacent panels, each panel retainer having a flange projecting laterally from rear faces opposite the front and inner faces and bent toward the panels to retain ends of the panels between the flange and the rear faces; and foam insulation disposed between the liner and shell.

2. A cabinet according to claim 1, wherein a length of the panels and depth of the corresponding panel retainers permit movement of the panel ends parallel with the length of the panels and within the retainers.

3. A cabinet according to claim 1, wherein the first retainer receives the edge of the inner liner between the end of the stem and an end of the first retainer and the second retainer receives the edge of the outer shell between the end of the branch and an end of the second retainer.

4. A cabinet according to claim 3, wherein the first retainer comprises a leg projecting laterally from the stem and bent back toward the end of the stem and the second retainer comprises a leg projecting laterally from the branch and bent back toward the end of the branch.

5. A cabinet comprising:

an outer shell;

an inner liner disposed in the shell;

a breaker assembly comprising four panels and four corners joining the panels to form a rectangle, each panel having a generally L-shaped cross section including a generally planar stem and a generally planar branch, a first retainer at an end of the stem, the first retainer having a leg projecting laterally from the stem and bent back toward the end of the stem so that an end of the leg is adjacent the end of the stem and retaining an edge of the inner liner between the end of the stem and the end of the first retainer leg, and a second retainer at an end of the branch, the second retainer having a leg projecting laterally from the branch and bent back at an acute angle toward the end of the branch and provided with a hook so that an end of the leg is adjacent the end of the branch and retaining an edge of the outer shell between the end of the branch and the end of the hook, the corners having panel retainers retaining ends of corresponding panels; and foam insulation disposed between the liner and shell.

6. A cabinet according to claim 5, wherein the leg of the first retainer projects laterally from the stem, curves to form an acute interior angle with respect to the stem, and is bent back at an acute angle.

7. A cabinet according to claim 5, wherein each corner has a generally flat front face corresponding with the branches of adjacent panels, an arcuate inner face corresponding with the stems of adjacent panels, and panel retainers along edges of the corner corresponding with the adjacent panels, each panel retainer having a flange projecting laterally from rear faces opposite the front and inner faces and bent toward the panels to retain ends of the panels between the flange and the rear faces.

8. A cabinet according to claim 5, wherein the leg of the second retainer projects at a substantially right angle to the branch.

9. A cabinet according to claim 8, wherein the leg of the second retainer and the end of the branch cooperate to form pincers including the hook and defining a gap for receiving the edge of the outer shell.

10. A cabinet according to claim 5, wherein the outer shell has an inwardly bent flange, an edge of the flange defines the edge of the outer shell, and the second retainer retains the edge of the flange.

11. A cabinet according to claim 10, wherein the ends of the breaker panels are generally coplanar with the adjacent liner and flange.

12. A cabinet comprising:

an inner liner having an opening;

an outer shell having an inwardly turned flange defining an opening the inner liner being received in the opening and defining an insulation space therebetween;

a breaker assembly comprising four panels and four corners joining the panels to form a rectangle that closes the insulation space, each panel having a generally L-shaped cross section including a generally planar stem and a generally planar branch, a first retainer at an end of the stem, the first retainer having a leg projecting laterally from the stem, curving to define an acute angle with respect to the stem, and bent back at an acute angle toward the end of the stem so that an end of the leg is adjacent the end of the stem and retaining an edge of the inner liner between the end of the stem and the end of the first retainer leg, and a second retainer at an end of the branch, the second retainer having a leg projecting laterally from the branch, bent back at an acute angle toward the end of the branch and having a hook so that an end of the leg is adjacent the end of the branch and retaining an edge of the outer shell between the end of the branch and the end of the second retainer leg, each corner having a generally flat front face corresponding with the branches of adjacent panels, an arcuate inner face corresponding with the stems of adjacent panels, panel retainers along edges of the corner corresponding with the adjacent panels, each panel retainer having a flange projecting laterally from rear faces opposite the front and inner faces and bent toward the panels to retain ends of the panels between the flange and the rear faces; and foam insulation disposed between the liner and shell.

13. A cabinet according to claim 12, further comprising a movable door closing the opening, the door having an interior contoured surface complementing the breaker assembly to provide a close fit therebetween.

14. A cabinet according to claim 13, further comprising a movable door closing the opening, the door having a magnetic gasket for sealing with the shell flange.

* * * * *